US007862701B2

(12) United States Patent
Noller et al.

(10) Patent No.: US 7,862,701 B2
(45) Date of Patent: Jan. 4, 2011

(54) ELECTRO-DIPCOATING APPARATUS

(75) Inventors: Thomas Noller, Stuttgart (DE); Markus Hoffmann, Bad Liebenzell (DE); Wolfgang Mauk, Stuttgart (DE); Andreas Hablizel, Reutlingen (DE)

(73) Assignee: Eisenmann Anlagenbau GmbH & Co. KG, Boeblingen (DE)

( * ) Notice: Subject to any disclaimer, the term of this patent is extended or adjusted under 35 U.S.C. 154(b) by 1192 days.

(21) Appl. No.: 11/496,269

(22) Filed: Jul. 31, 2006

(65) Prior Publication Data

US 2007/0029203 A1 Feb. 8, 2007

(30) Foreign Application Priority Data

Aug. 1, 2005 (DE) ..... 10 2005 036 115

(51) Int. Cl.
*C25D 17/08* (2006.01)

(52) U.S. Cl. ..... 204/623

(58) Field of Classification Search ..... 204/623
See application file for complete search history.

(56) References Cited

U.S. PATENT DOCUMENTS 5,223,116 A * 6/1993 Hosten ..... 204/623
5,494,561 A * 2/1996 Darche et al. ..... 204/625
2008/0271993 A1* 11/2008 Noller ..... 204/228.8

FOREIGN PATENT DOCUMENTS

DE 1 970 438 U 10/1967
DE 200 00 970 U1 4/2000
DE 199 42 556 C2 3/2001

* cited by examiner

*Primary Examiner*—Kishor Mayekar
(74) *Attorney, Agent, or Firm*—Factor & Lake, Ltd.

(57) ABSTRACT

An electro-dipcoating apparatus is described in which, in conventional manner, a work-piece to be lacquered is dipped into a lacquer bath, moved through the latter, and lifted out again in a continuous process. Along the path of motion of the work-piece in the lacquer bath there are arranged electrodes which are connected to a first pole of at least one voltage source. Several contact rails extend parallel to one another without electrical interruption along the entire path of motion of the work-piece leading through the lacquer bath and are each connected to the second pole of varying voltage sources. To each work-piece a contact device is assigned which can be brought into communication with a respective one of the several contact rails and in this way applies the potential of the second pole of the corresponding voltage source to the work-piece. In this way, cuts in the contact rails are avoided that would result in wear of the contact devices and in increased control effort.

17 Claims, 5 Drawing Sheets

ELECTRO-DIPCOATING APPARATUS

RELATED APPLICATIONS

The present invention claims the benefit of the filing date of German Patent Application, Ser. No. 10 2005 036 115.3, filed Aug. 1, 2005.

TECHNICAL FIELD

The present invention is related to depositing material on a work-piece, and more specifically, to an electro-dipcoating apparatus.

BACKGROUND OF THE INVENTION

In the course of electro-dipcoating, also called electrophoretic painting, the lacquer constituents in the lacquer bath are deposited on the work-pieces under the influence of an electric field. It has proved expedient not to keep the electric field constant during the passage of the work-pieces through the lacquer bath, but rather to vary it along the path of motion, in particular to cause it to increase with the distance travelled. One of the reasons for this measure is the fact that the lacquer layer that is being built up constitutes an electrical resistance which renders further build-up of the lacquer layer difficult.

Consequently the problem arises as to how the voltage for each work-piece can be changed in the course of passing through the lacquer bath. With electro-dipcoating apparatuses of the type mentioned in the introduction—such as are described in DE 199 42 556 C2, for example—the supply of current to the work-piece is effected via a contact rail that is divided into individual sections in the direction of motion of the work-pieces to be lacquered; the sections are galvanically isolated and are connected to a pole of a voltage source assigned to each section. The electrodes arranged along the path of motion of the work-pieces in the lacquer bath are connected to the other pole of the voltage sources. A disadvantageous aspect of this arrangement is that it is relatively difficult to track, by methods of control engineering, the path of each individual work-piece along the various sections of the contact rail and to bring about the transition of the work-piece from one section to another without a 'jump' in potential. Since the charge that has flowed between the electrode and the work-piece is used as a measure of the layer thickness applied, it is also necessary to switch the measurement of the current flowing to the work-piece concomitantly, section by section, with the motion of the work-piece. Finally, the 'cuts' in the contact rails, which bring about the galvanic isolation, also constitute surface irregularities in the contact rail, which result in wear of the contact devices that are moved concomitantly with the work-pieces.

In the event of a change in the type of work-piece—for example, a change in the length of the work-piece—or in the event of a change in the immersion curve, the positions of the cuts between the contact-rail sections change, so that a change of plant is required for an optical coating.

SUMMARY OF THE INVENTION

The present invention is directed to an electro-dipcoating apparatus including a lacquer bath; a conveying device by which work-pieces to be lacquered can be dipped into the lacquer bath, moved through the latter, and lifted out again in a continuous process; at least two voltage sources; electrodes arranged in the lacquer bath along the path of motion of the work-pieces, which are connected to a first pole of at least one voltage source; at least one contact rail which extends along the path of motion of the work-pieces and is connected to a second pole of at least one voltage source; for each work-piece, a contact device which is connected to at least one contact rail and which consequently applies the potential of the second pole of the at least one voltage source to the work-piece.

In one aspect of the present invention, the contact device includes a contact shoe and is arranged in such a way that the contact shoe can be brought into various positions corresponding to the several contact rails.

In a further aspect of the present invention, the contact device exhibits a fluid-operated cylinder by which the contact shoe can be displaced.

In yet another aspect of the present invention, the contact device exhibits an electrically operated actuator by which the contact shoe can be displaced.

In a still further aspect of the present invention, the contact device exhibits a latching device with which the contact shoe can be releasably locked in the various positions.

In still another aspect of the present invention, the fluid-operated cylinder or the electrical actuator is capable of being moved concomitantly with the work-piece.

In yet another aspect of the present invention, the fluid-operated cylinder or the electrical actuator is stationary.

An alternate aspect of the present invention includes, for each contact rail, a contact shoe that is capable of being moved along the respective contact rail is assigned to each work-piece and in that for each work-piece an electrical change-over switch is provided, with which the various contact shoes assigned to the work-piece can optionally be switched through to the work-piece.

Another further aspect of the present invention includes a points-type guiding device with a relocatable guiding member with which a contact shoe can optionally be routed onto one of the various contact rails in the course of its motion.

One object of the present invention is to configure an electro-dipcoating apparatus of the type mentioned in the introduction in such a way that it can be controlled more easily and it gives rise to less wear on the contact devices.

Another object of the present invention is to provide several contact rails which extend parallel to one another without electrical interruption along the entire path of motion of the work-pieces leading through the lacquer bath and which are each connected to the second pole of varying voltage sources.

Another object of the present invention is to provide at least as many contact rails as there are work-pieces to be located in the lacquer bath simultaneously. It is then possible to assign to each work-piece a single contact rail, the potential of which during the passage of the work-pieces through the lacquer bath can be varied over the entire length without thereby changing the voltage applied to the other work-pieces. In this way the troublesome 'cuts' in the contact rails are avoided which, in the state of the art, resulted, on the one hand, in increased control effort and, on the other hand, in undesirable wear. The invention allows a more individual adaptation of the carrying of voltage to the individual work-piece along the path of motion. As a result, the layer thicknesses can be adhered to more accurately, resulting in savings of lacquer.

Another object of the present invention is provide a contact device including a contact shoe that is set up in such a way that the contact shoe can be brought into various positions corresponding to the several contact rails. In this case, by determination of the position of the contact shoe it can accordingly be established anew for each work-piece which of the several contact rails running parallel to one another-for example, running one above the other-is "responsible" for this work-piece. The displacement of the contact shoe is effected under the influence of the central plant control system.

Another object of the present invention is to provide a contact device having a latching device with which the contact shoe can be releasably locked in various positions. This facilitates the locating of the correct position for the contact shoe, as well as the retention of this height position in the course of the motion of the work-piece along the assigned contact rail.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

The invention is now described hereinafter with the aid of examples of implementation and with reference to the accompanying drawings, in which.

DETAILED DESCRIPTION OF THE PRESENT INVENTION

Figure 1:
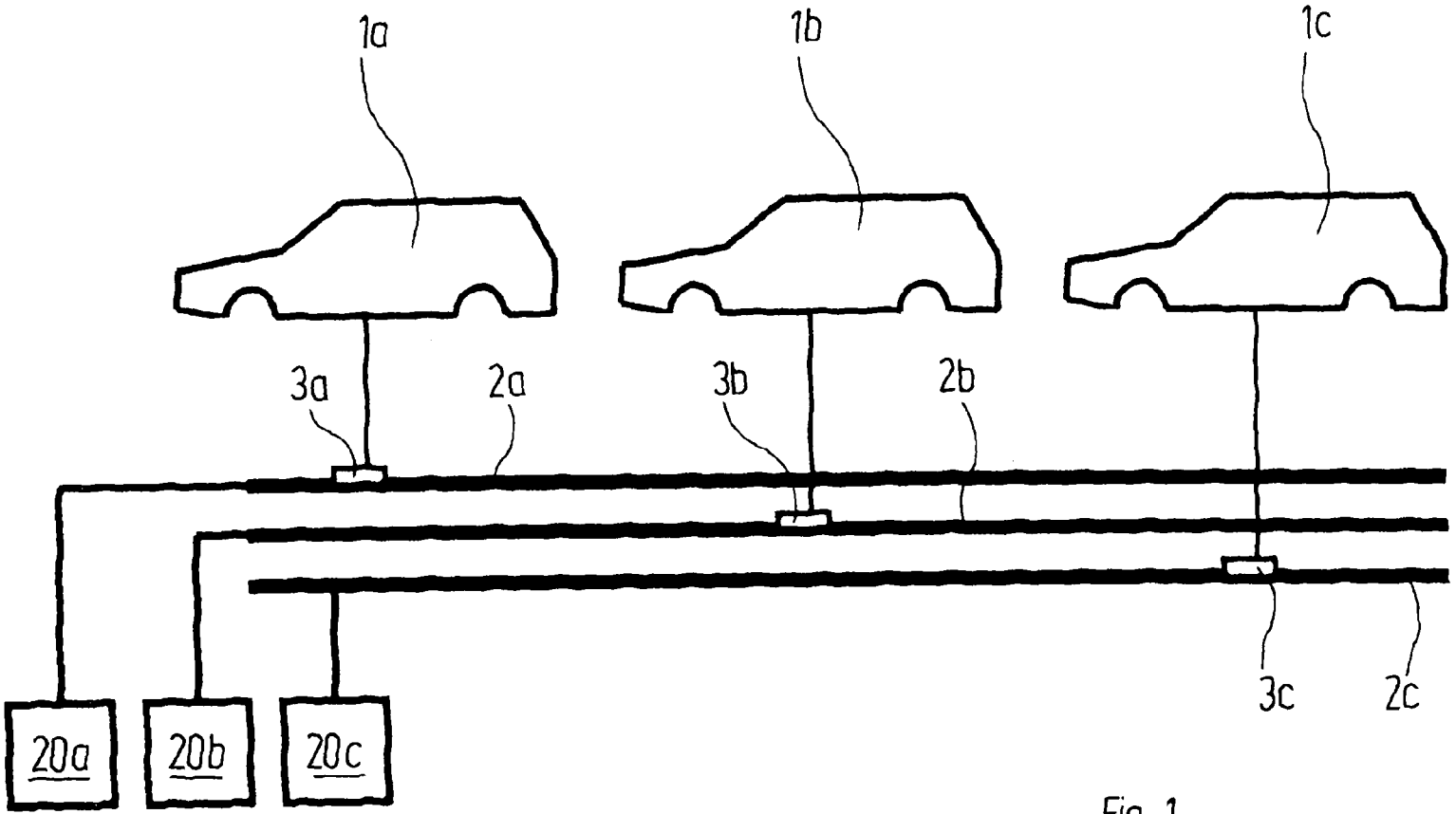
FIG. 1 schematically, a first type of contacting of vehicle bodies in an electro-dipcoating bath.

While the present invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Reference will firstly be made to FIG. 1. The latter shows a total of three vehicle bodies 1*a*, 1*b*, 1*c* which may be imagined to be dipped in a lacquer reservoir filled with lacquer liquid, as described in DE 199 42 566 C2, already mentioned above. The lacquer reservoir is not represented in FIG. 1, and neither 20 is the conveying device by which the various vehicle bodies 1 are moved through the lacquer reservoir continuously or intermittently. A suspended conveyor such as is represented by way of conveying device 12 in DE 199 42 56 C2 comes into consideration, for example, but so too does a conveying device that makes use of individual, independently movable and controllable trucks.

In the lacquer reservoir, which is not represented, counter-electrodes, in particular anodes, are placed in known manner along the path of motion of the vehicle bodies 1*a*, 1*b*, 1*c*, as can likewise be gathered from DE 199 42 56 C2. The deposition of the lacquer constituents on the vehicle bodies 1*a*, 1*b*, 1*c* takes place in the electric field that arises within the lacquer liquid between the counter-electrodes and the vehicle bodies 1*a*, 1*b*, 1*c*. The number of ampere-hours that have flowed between the counter-electrodes and the vehicle bodies 1*a*, 1*b*, 1*c* in the course of passing through the lacquer reservoir represents a direct measure of the thickness of the lacquer layer that has been deposited.

In order to generate the requisite electric field for the electrophoretic deposition of the lacquer, the vehicle bodies 1*a*, 1*b*, 1*c* have to be connected, during their motion through the lacquer bath, to the corresponding pole of a d.c. voltage source—in the familiar case of cataphoretic dipcoating, to the negative pole of said source.

This contacting comes about in the following way:

Along the path of motion of the vehicle bodies 1*a*, 1*b*, 1*c* leading through the lacquer reservoir, but outside the lacquer liquid, there extend just as many contact rails 2*a*, 2*b*, 2*c* as the largest number of vehicle bodies 1*a*, 1*b*, 1*c* that are present in the lacquer bath simultaneously. In the present case there are accordingly three contact rails 2*a*, 2*b*, 2*c*. These contact rails 2*a*, 2*b*, 2*c* are uninterrupted over their entire length and consequently do not exhibit the 'cuts' that are customary in the state of the art—that is to say, points at which various sections of the contact rails 2*a*, 2*b*, 2*c* are attached to one another in electrically insulated manner. Each contact rail 2*a*, 2*b*, 2*c* is connected to a pole, preferably the negative pole, of a separate controllable d.c. voltage source 20*a*, 20*b*, 20*c*. The other pole of these d.c. voltage sources 20*a*, 20*b*, 20*c* is connected to the electrodes, preferably anodes, arranged along the path of motion.

The assignment of the vehicle bodies 1*a*, 1*b*, 1*c* to the corresponding contact rails 2*a*, 2*b*, 2*c*, and hence to the corresponding d.c. voltage sources 20*a*, 20*b*, 20*c*, comes about by virtue of the fact that the contact rails 2*a*, 2*b*, 2*c* extend at varying heights along the path of motion of the vehicle bodies 1*a*, 1*b*, 1*c*. In the case of the exemplary embodiment represented in FIG. 1, the contact rail 2*a* extends at the highest level, the contact rail 2*c* extends at the lowest level, and the contact rail 2*b* extends between the contact rails 2*a* and 2*c*. In this way it is possible to cause a contact shoe 3*a*, 3*b*, 3*c*, which is electrically and mechanically connected to the respective vehicle body 1*a*, 1*b*, 1*c*, to be displaced along the entire length of each respective contact rail 2*a*, 2*b*, 2*c*.

By virtue of the arrangement that has been described, it is possible to adjust individually the voltage applied to the vehicle bodies 1*a*, 1*b*, 1*c* and also to change it on the path of motion of said bodies within the lacquer reservoir without influencing the respective other vehicle bodies 1*a*, 1*b*, 1*c* which are located within the lacquer reservoir. The application of voltage pulses to individual vehicle bodies 1*a*, 1*b*, 1*c* within certain sections of the path of motion is also possible.

By reason of the absence of contact-rail cuts which are always associated with mechanical surface irregularities, the wear on the contact shoes 3*a*, 3*b*, 3*c* is less than was the case in the state of the art. By virtue of the fact that the individual sections of the contact rails, separated by 'cuts', no longer exist, in addition the control device turns out to be simpler.

Figure 2:
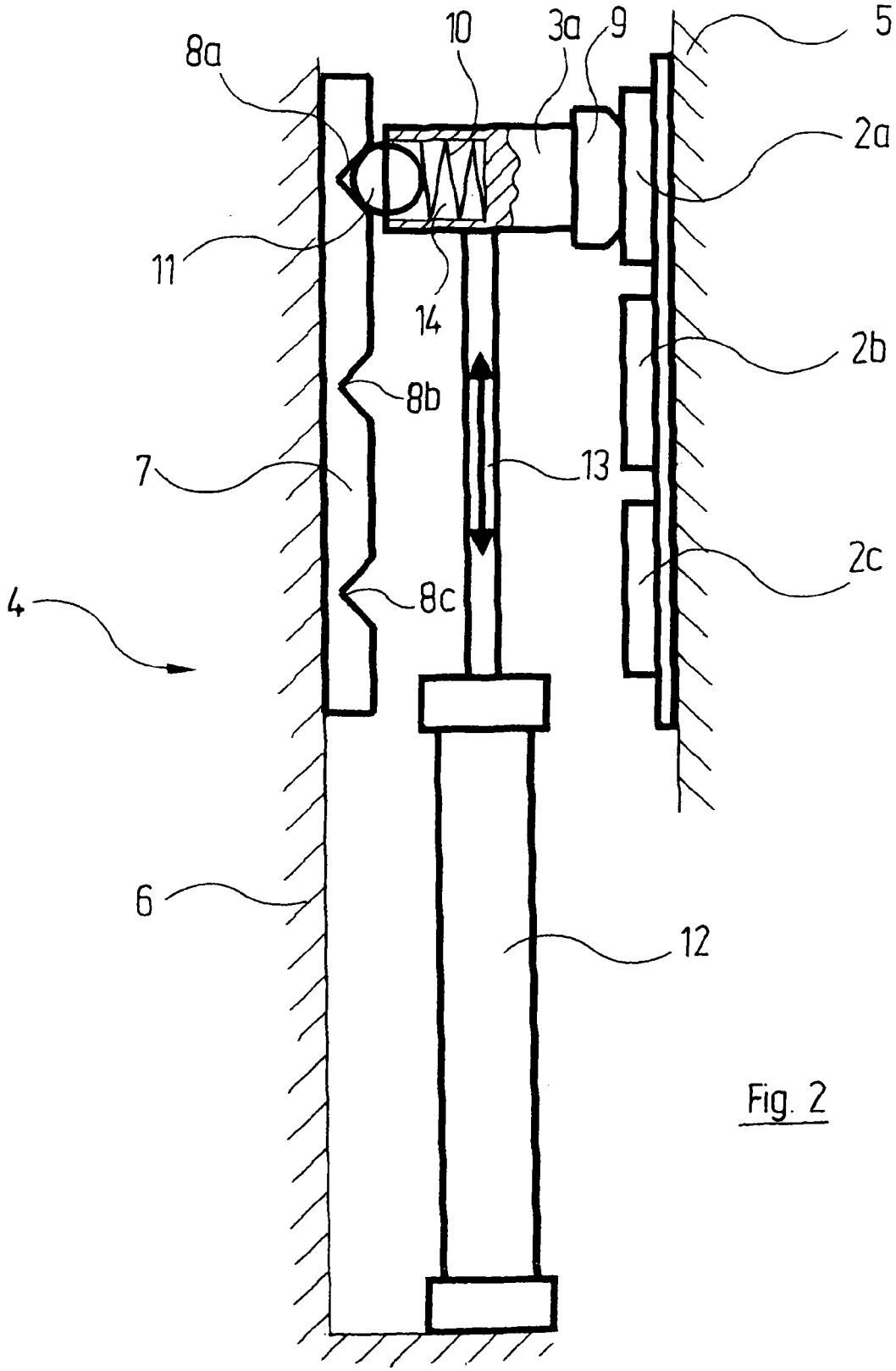
FIG. 2 likewise schematically, a first exemplary embodiment of an adjustable contact device which each vehicle body in FIG. 1 possesses.

Located on the path of motion of the vehicle bodies 1*a*,1*b*, 1*c* upstream of the entrance to the lacquer bath is a contact-adjusting device which is labelled overall by the reference symbol 4 and which is represented schematically in FIG. 2. For each vehicle body 1*a*,1*b*, 1*c* entering the lacquer bath this contact-adjusting device 4 serves to bring the corresponding contact shoe 3*a*, 3*b*, 3*c* to the correct height, so that the correct contact rail 2*a*, 2*b*, 2*c* is contacted on the further path.

In FIG. 2, which represents a section perpendicular to the direction of motion of the vehicle bodies 1*a*, 1*b*, 1*c*, the contact rails are again designated by the reference symbols 2*a*, 2*b*, 2*c*; they are secured to an arbitrary fixed support structure 5. At a spacing from the support structure 5 and from the contact rails 2*a*, 2*b*, 2*c* secured thereto, an element 6 of the conveying device is moving past which is assigned to one of the vehicle bodies 1*a*, 1*b*, 1*c*. For example, it may be a question of an element of an overhead-conveyor truck or of an independently movable truck which guides the vehicle body 1*a*, 1*b*, 1*c* with it.

On a vertical lateral face of the element 6 a plate 7 is secured which in turn possesses, on its vertical side facing away from the element 6, three grooves 8*a*, 8*b*, 8*c* which are V-shaped in cross-section. Instead of grooves, conical recesses may also be provided.

As FIG. 2 shows, between one of the grooves 8*a*, 8*b*, 8*c*—in the present case, groove 8*a*—and one of the contact rails 2*a*, 2*b*, 2*c* —in the present case, contact rail 2*a*—there extends the contact shoe 3*a* pertaining to vehicle body 1*a*. Said contact shoe is a substantially cylindrical part which on its end face, which is rounded in the form of a spherical cap and which points towards the contact rail 2*a*, bears the actual contact 9. At least the outermost layer thereof consists of electrically conductive carbon.

The end region of the contact shoe 3*a* facing towards the plate 7, and hence towards the groove 8*a*, is provided with a blind hole 10, into which a latching ball 11 can be more or less inserted. The latching ball 11 is pushed into the groove 8*a* by a compression spring 14 which is fastened between it and the bottom of the blind hole 10. The entire contact shoe 3*a* can be adjusted in the directions of the double-headed arrow 13 with the aid of a pneumatic cylinder 12 or with the aid of another actuator which is moved concomitantly with the vehicle body 1*a* on the conveying device 6.

The contact-adjusting device 4 which has been described operates as follows:

At the beginning of the path of motion of each vehicle body 1*a*, 1*b*, 1*c* through the lacquer reservoir, or even before entering this path of motion, the control system, under which the entire electro-dipcoating plant operates, assigns to the respective vehicle body 1*a*, 1*b*, 1*c* a contact rail 2*a*, 2*b*, 2*c* via which the vehicle body 1*a*, 1*b*, 1*c* in question is brought to the appropriate voltage during the lacquer-deposition process. The pneumatic cylinder 12 is now addressed by the control system in such a way that it brings the contact shoe 3*a*, 3*b*, 3*c* of the corresponding vehicle body 1*a*, 1*b*, 1*c* to the correct height, at which the conducting contact 9 is in abutment against the corresponding contact rail 2*a*, 2*b*, 2*c*. The locating and retention of the correct height is facilitated by the latching device which is constituted by the grooves 8*a*, 8*b*, 8*c* and the latching ball 11 of the contact shoe 3*a*.

The respective vehicle body 1*a*, 1*b*, 1*c* can now be guided through the lacquer reservoir, in the course of which a voltage that changes temporally where appropriate is constantly applied to the vehicle body 1*a*, 1*b*, 1*c*. Monitoring of the layer thickness of lacquer which is being formed is very easily possible via the charge that has flowed, since only a single current, which has flowed via a contact rail 2*a*, 2*b*, 2*c*, needs to be measured, without section-by-section switching.

Figure 3:
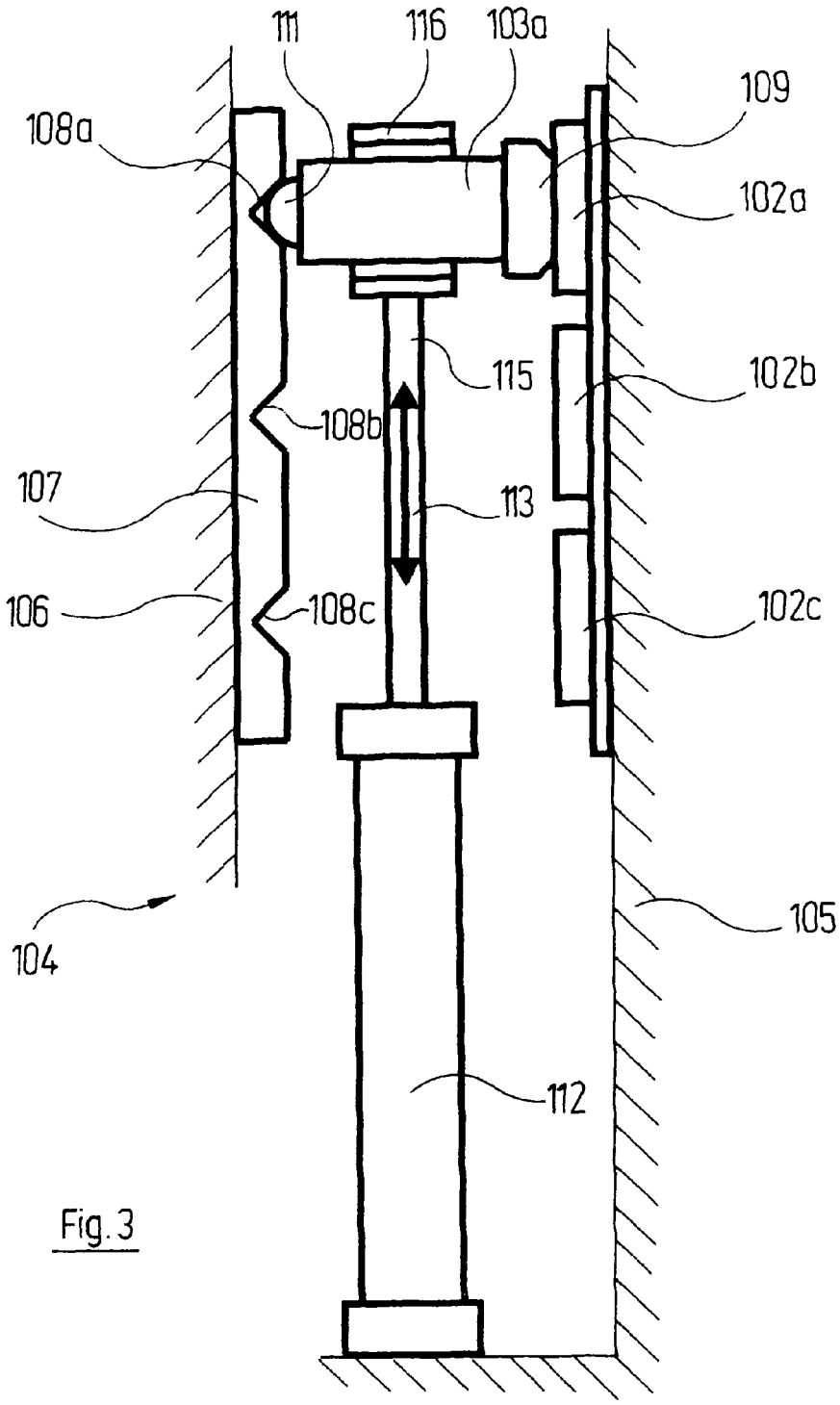
FIG. 3 similar to FIG. 2, a second exemplary embodiment of an adjustable contact device.

In FIG. 3 another embodiment of a contact-adjusting device 104 is represented which is very similar to that described above with reference to FIG. 2. Corresponding parts are therefore labelled in FIG. 3 with the same reference symbols as in FIG. 2, plus 100.

The most important difference between the two contact-adjusting devices 4 and 104 is the fact that in the case of the contact-adjusting device shown in FIG. 3 the pneumatic cylinder 112 is not connected to the conveying device 106 but is rigidly connected to an element 105 of the fixed support structure—that is to say, it is itself stationary. Located at the end of the piston rod 115 of the pneumatic cylinder 112 is a fork 116 which is open laterally—in FIG. 3 towards the front contrary to the direction of view—and which is able to encompass the contact shoe 103*a* for the purpose of vertical displacement. Once the displacement has occurred, the contact shoe 103*a* is able to move forwards out of the fork 116 in FIG. 3 in the course of the further motion of the vehicle body 101*a*.

In the case of the manner of contacting of the various vehicle bodies 1*a*, 1*b*, 1*c* that has been represented in FIG. 1 and described above, the assignment of the individual vehicle bodies 1*a*, 1*b*, 1*c* to the individual contact rails 2*a*, 2*b*, 2*c*was effected by the mechanical operating contact-adjusting device 4 or 104 according to FIG. 2 or FIG. 3, respectively. In the exemplary embodiment according to FIG. 4 this mechanical switching operation is replaced by an electrical switching operation.

Figure 4:
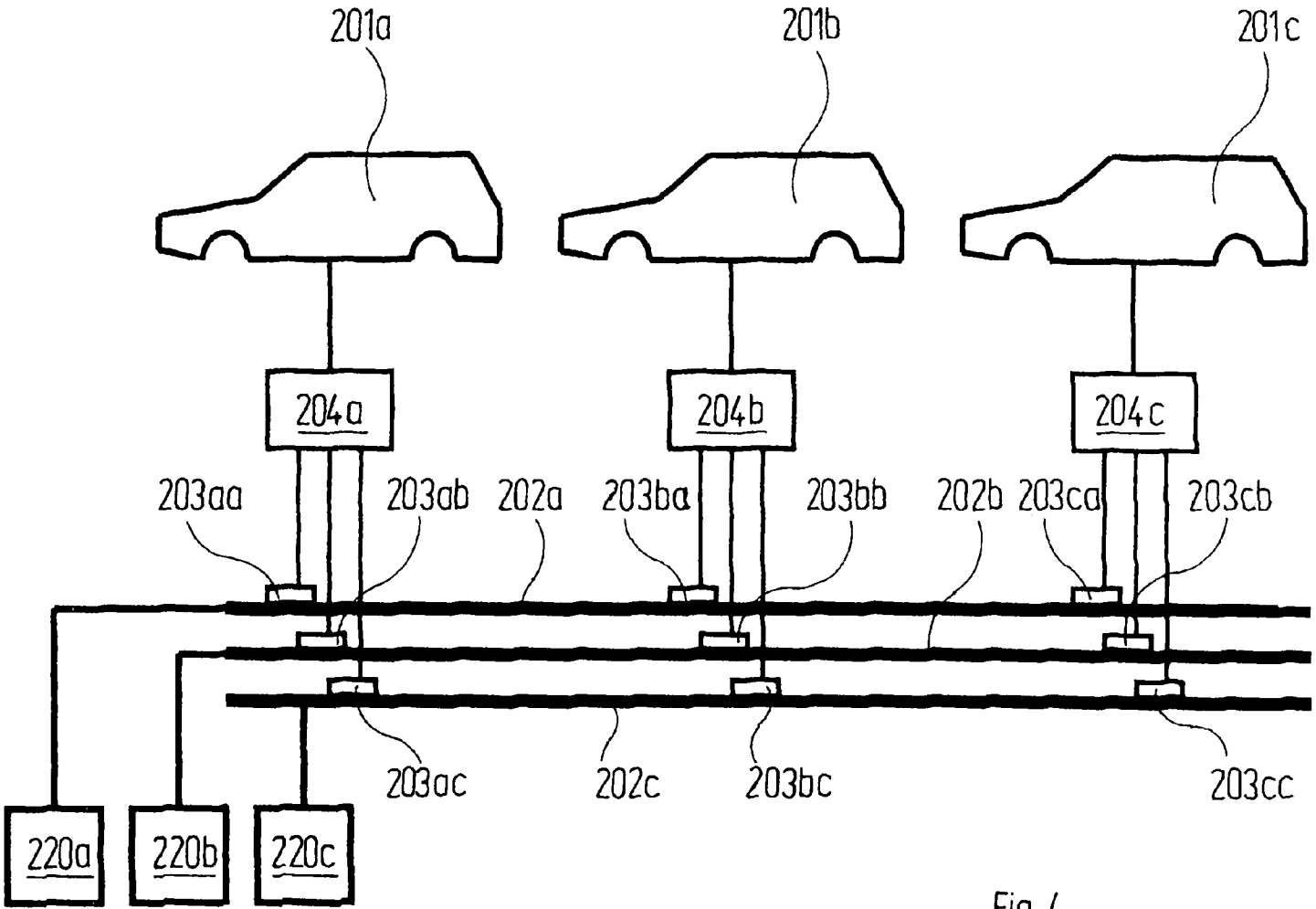
FIG. 4 similar to FIG. 1, a second type of contacting of vehicle bodies.

In FIG. 4, parts that correspond to those shown in FIG. 1 bear the same reference symbol plus 200. To the extent that they are unchanged in their function, they will not be considered again below.

To each vehicle body 201*a*, 201*b*, 201*c* in FIG. 4 an electrically controllable change-over switch 204*a*, 204*b*, 204*c* is assigned which is moved concomitantly with the vehicle body 201*a*, 201*b*, 201*c* in question. To each vehicle body 201*a*, 201*b*, 201*c* there pertain, in addition, three contact shoes 203*aa*, 203*ab*, 203*ac*, 203*ba*, 203*bb*, 203*bc*, 203*ca*, 203*cb*, 203*cc* which can be moved concomitantly with the vehicle body 201*a*, 201*b*, 201*c* along a respective one of the three contact rails 202*a*, 202*b*, 202*c*. These contact shoes 203 can be switched through to the respective vehicle body 201*a*, 201*b*, 201*c* by the respective change-over switch 204*a*, 204*b*, 204*c*, optionally in response to a control command.

Figure 5:
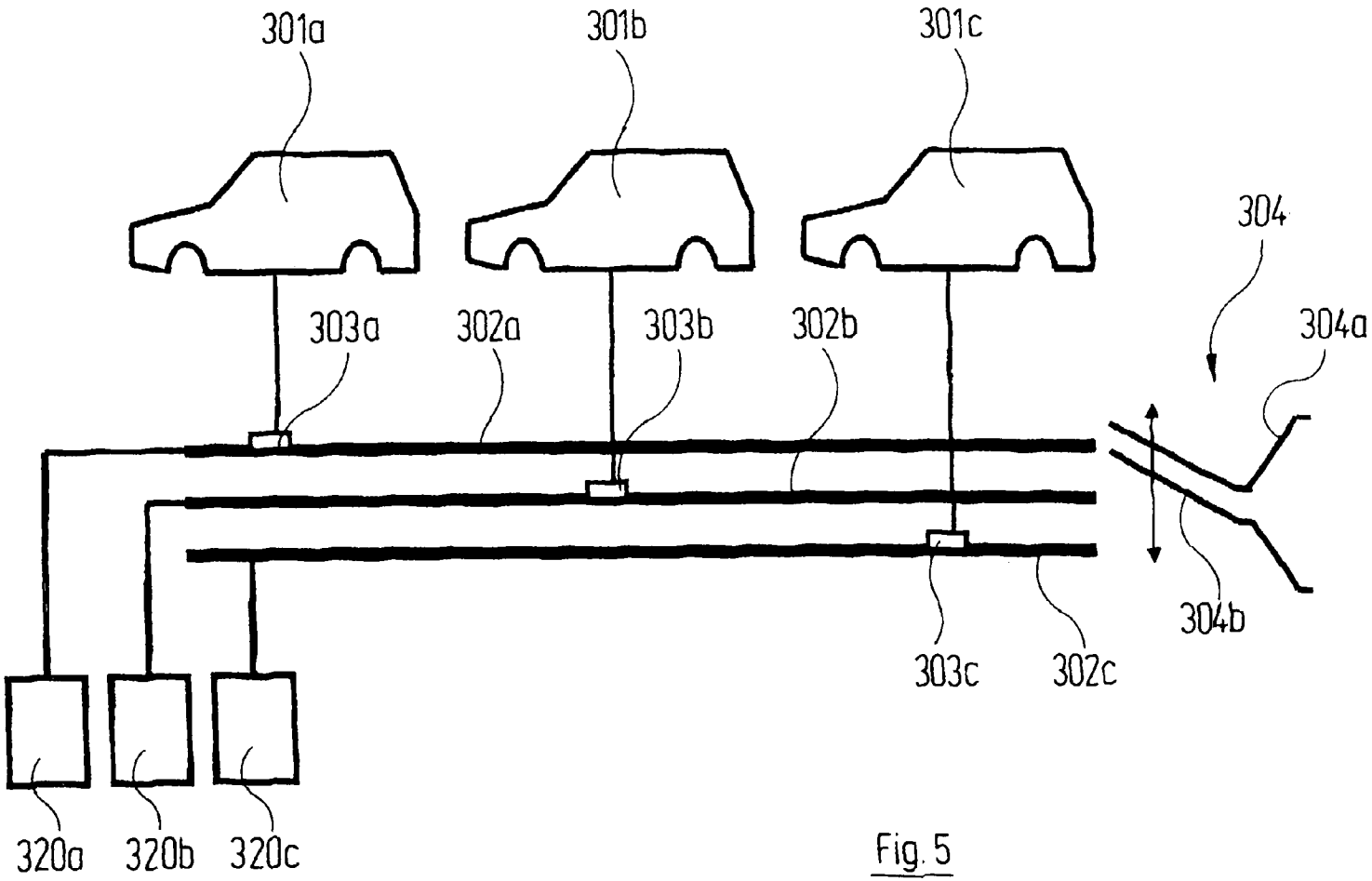
FIG. 5 similar to FIG. 1, a third type of contacting of vehicle bodies.

A further example of how the individual work-pieces can be assigned to certain contact rails is shown in FIG. 5. In this Figure, parts that correspond to those shown in FIG. 1 are labelled with the same reference symbols plus 300. The fundamental structure in FIG. 5, with the several contact rails 302*a*, 302*b*, 302*c*, with the contact shoes 303*a*, 303*b*, 303*c* sliding thereon, and with the d.c. voltage sources 320*a*, 320*b*, 320*c*, is the same as in FIG. 1.

Upstream of the contact rails 302*a*, 302*b*, 302*c* in the direction of motion of the vehicle bodies 301*a*, 301*b*, 301*c* a points-type guiding device 304 replacing the change-over device 4 and 104 shown in FIGS. 2 and 3, respectively, is provided. Said guiding device possesses a catching funnel 304*a*, into which the contact shoes 303*a*, 303*b*, 303*c* of all the approaching vehicle bodies 301*a*, 301*b*, 301*c* are introduced, irrespective of their height position in the course of their motion. The contact shoes 303*a*, 303*b*, 303*c*, which are guided in vertically mobile manner on the conveying device, are all brought to the same height position in the catching funnel 304*a* and arrive in a guiding member 304*b*. The latter is able to be swivelled in such a way, under the commands of the plant control system, that its outlet is optionally situated at the height of the contact rail 302*a*, 302*b* or 302*c*. In this way, each contact shoe 303*a*, 303*b*, 303*c* runs in automatically onto the contact rail 302*a*, 302*b*, 302*c* intended for it.

It is to be understood that additional embodiments of the high-speed door assembly described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. An electro-dipcoating apparatus for coating a work-piece, the electro-dipcoating apparatus comprising:

a lacquer bath;

a conveying device by which the work-piece to be lacquered can be dipped into the lacquer bath, moved through the latter, and lifted out again in a continuous process;

at least two voltage sources;

electrodes arranged in the lacquer bath along the path of motion of the work-piece, which are connected to a first pole of the at least two voltage sources;

several contact rails which extend parallel to one another without electrical interruption along an entire path of motion of the work-piece leading through the lacquer bath each of the contact rails being connected to a second pole of one the at least two voltage sources; and, a contact device which is connected to one of the several contact rails and which applies a potential of the second pole of one of the at least two voltage sources to the work-piece.

2. The electro-dipcoating apparatus of claim 1, wherein the contact device comprises a contact shoe and is arranged in such a way that the contact shoe can be brought into various positions to contact each of the several contact rails.

3. The electro-dipcoating apparatus of claim 2, wherein the contact device exhibits a fluid-operated cylinder by which the contact shoe can be displaced.

4. The electro-dipcoating apparatus of claim 3, wherein the contact device exhibits a latching device with which the contact shoe can be releasably locked in the various positions.

5. The electro-dipcoating apparatus of claim 4, wherein the fluid-operated cylinder is capable of being moved concomitantly with the work-piece.

6. The electro-dipcoating apparatus of claim 4, wherein the fluid-operated cylinder is stationary.

7. The electro-dipcoating apparatus of claim 3, wherein the fluid-operated cylinder is capable of being moved concomitantly with the work-piece.

8. The electro-dipcoating apparatus of claim 3, wherein the fluid-operated cylinder is stationary.

9. The electro-dipcoating apparatus of claim 2, wherein the contact device exhibits an electrically operated actuator by which the contact shoe can be displaced.

10. The electro-dipcoating apparatus of claim 9, wherein the contact device exhibits a latching device with which the contact shoe can be releasably locked in the various positions.

11. The electro-dipcoating apparatus of claim 10, wherein the electrical actuator is capable of being moved concomitantly with the work-piece.

12. The electro-dipcoating apparatus of claim 10, wherein the electrical actuator is stationary.

13. The electro-dipcoating apparatus of claim 9, wherein the electrical actuator is capable of being moved concomitantly with the work-piece.

14. The electro-dipcoating apparatus of claim 9, wherein the electrical actuator is stationary.

15. The electro-dipcoating apparatus of claim 2, wherein the contact device exhibits a latching device with which the contact shoe can be releasably locked in the various positions.

16. The electro-dipcoating apparatus of claim 1, wherein for each contact rail a contact shoe that is capable of being moved along the respective contact rail, and wherein each contact rail is assigned to a work-piece and in that for each work-piece an electrical change-over switch is provided, with which the contact shoes assigned to the work-piece can optionally be switched through to the work-piece.

17. The electro-dipcoating apparatus of claim 1, wherein a guiding device with a relocatable guiding member with which a contact shoe can optionally be routed onto one of the various contact rails in the course of its motion.

* * * * *